US010166786B2

(12) United States Patent
Chiba

(10) Patent No.: US 10,166,786 B2
(45) Date of Patent: Jan. 1, 2019

(54) DEVICE INCLUDING MOVABLE HEAD AND HEAD CONTROL METHOD

(71) Applicant: Takehiro Chiba, Kanagawa (JP)

(72) Inventor: Takehiro Chiba, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/613,605

(22) Filed: Jun. 5, 2017

(65) Prior Publication Data

US 2017/0348969 A1 Dec. 7, 2017

(30) Foreign Application Priority Data

Jun. 7, 2016 (JP) ..... 2016-113502
Jun. 1, 2017 (JP) ..... 2017-109579

(51) Int. Cl.

| | |
|---|---|
| ***B41J 2/045*** | (2006.01) |
| ***B41J 11/00*** | (2006.01) |
| ***B41J 2/21*** | (2006.01) |
| ***B41J 19/20*** | (2006.01) |
| ***B41J 25/00*** | (2006.01) |
| *B65H 5/02* | (2006.01) |

(52) U.S. Cl.
CPC ..... *B41J 11/007* (2013.01); *B41J 2/2146* (2013.01); *B41J 19/205* (2013.01); *B41J 25/001* (2013.01); *B65H 5/026* (2013.01)

(58) Field of Classification Search
CPC ... B41J 2/04505; B41J 2/04503; B41J 11/007
See application file for complete search history.

(56) References Cited

U.S. PATENT DOCUMENTS

| | | | |
|---|---|---|---|
| 2010/0310284 | A1 | 12/2010 | Funato et al. |
| 2014/0044460 | A1 | 2/2014 | Kudo et al. |
| 2014/0219670 | A1 | 8/2014 | Masuda et al. |
| 2014/0268180 | A1 | 9/2014 | Takaura et al. |

(Continued)

FOREIGN PATENT DOCUMENTS

JP 2011-131551 7/2011

OTHER PUBLICATIONS

U.S. Appl. No. 15/373,807, filed Dec. 9, 2016.

(Continued)

*Primary Examiner* — Jason S Uhlenhake
(74) *Attorney, Agent, or Firm* — Harness, Dickey & Pierce, P.L.C.

(57) ABSTRACT

A device includes a head to perform an operation on a conveyed object; a head moving device to move the head in a width direction orthogonal to a conveyance direction of the conveyed object; a position detector to detect a position of the conveyed object in the width direction; a speed detector to detect a moving speed of the conveyed object in the width direction; a position predictor to obtain a predicted width position of the conveyed object after a predetermined period, based on a detected position of the conveyed object and a detected moving speed of the conveyed object; a speed calculator to calculate a travel speed of the head; and a head travel controller to control the head moving device to move the head at the calculated travel speed. With the calculated travel speed, the head arrives at the predicted width position after the predetermined period.

19 Claims, 13 Drawing Sheets

(56) References Cited

U.S. PATENT DOCUMENTS

| | | | | |
|---|---|---|---|---|
| 2015/0009262 | A1 | 1/2015 | Bell et al. | |
| 2016/0114576 | A1 | 4/2016 | Tobita | |
| 2016/0121602 | A1 | 5/2016 | Nagasu et al. | |
| 2016/0136947 | A1 | 5/2016 | Hommi | |
| 2016/0347050 | A1 | 12/2016 | Hommi | |
| 2017/0106647 | A1* | 4/2017 | Inoue | B41J 2/04505 |

OTHER PUBLICATIONS

U.S. Appl. No. 15/373,825, filed Dec. 9, 2016.
U.S. Appl. No. 15/382,963, filed Dec. 19, 2016.
U.S. Appl. No. 15/455,539, filed Mar. 10, 2017.
U.S. Appl. No. 15/456,677, filed Mar. 13, 2017.

* cited by examiner

DEVICE INCLUDING MOVABLE HEAD AND HEAD CONTROL METHOD

CROSS-REFERENCE TO RELATED APPLICATIONS

This patent application is based on and claims priority pursuant to 35 U.S.C. § 119(a) to Japanese Patent Application Nos. 2016-113502 filed on Jun. 7, 2016, and 2017-109579 filed on Jun. 1, 2017 in the Japan Patent Office, the entire disclosure of each of which is hereby incorporated by reference herein.

BACKGROUND

Technical Field

Embodiments of the present invention relate to a device including a movable head to move in a direction orthogonal to a direction of conveyance of a conveyed object on which the head performs an operation, a method of controlling the head, and a recording medium storing a program to control the head.

Description of the Related Art

There are various types of devices using a movable head. For example, there are recording devises that conveys a long, continuous sheet (e.g., a recording medium) and includes a liquid discharge head to apply ink discharged from a plurality of nozzles to the continuous sheet to form an image on the continuous sheet.

In such recording devises, for example, crease and meandering (or drifting out of alignment) of the sheet can cause variations in an ink discharge position, at which the ink strikes the sheet. In the case of color image formation using a plurality of liquid discharge heads, the accuracy in alignment in superposition of different colors may he degraded.

SUMMARY

According to an embodiment of this disclosure, a device includes a head to perform an operation on a conveyed object; a head moving device to move the head in a width direction orthogonal to a conveyance direction in which the conveyed object is conveyed; a position detector to detect a position of the conveyed object in the width direction; a speed detector to detect a moving speed of the conveyed object in the width direction; a position predictor to obtain a predicted width position of the conveyed object after elapse of a predetermined period, based on a detection result generated by the position detector and a detection result generated by the speed detector; a speed calculator to calculate a travel speed of the head in the width direction to cause the head to arrive at the predicted width position after the elapse of the predetermined period; and a head travel controller to control the head moving device to move the head at the calculated travel speed.

Another embodiment provides a method of controlling a head to perform an operation on a conveyed object conveyed in a conveyance direction. The method includes moving the head in a width direction orthogonal to the conveyance direction of the conveyed object; detecting a position of the conveyed object in the width direction; detecting a moving speed of the conveyed object in the width direction; predicting a predicted width position of the conveyed object after elapse of a predetermined period, based on a detected position of the conveyed object and a detected moving speed of the conveyed object; calculating a travel speed of the head in the width direction to cause the head to arrive at the predicted width position after the elapse of the predetermined period; and moving the head at the calculated travel speed.

Another embodiment provides a computer-readable non-transitory recording medium storing a program for causing a computer to execute the method described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 10A and 11.0B are graphs of results of the position control according to Comparative example 1;

Figure 1:
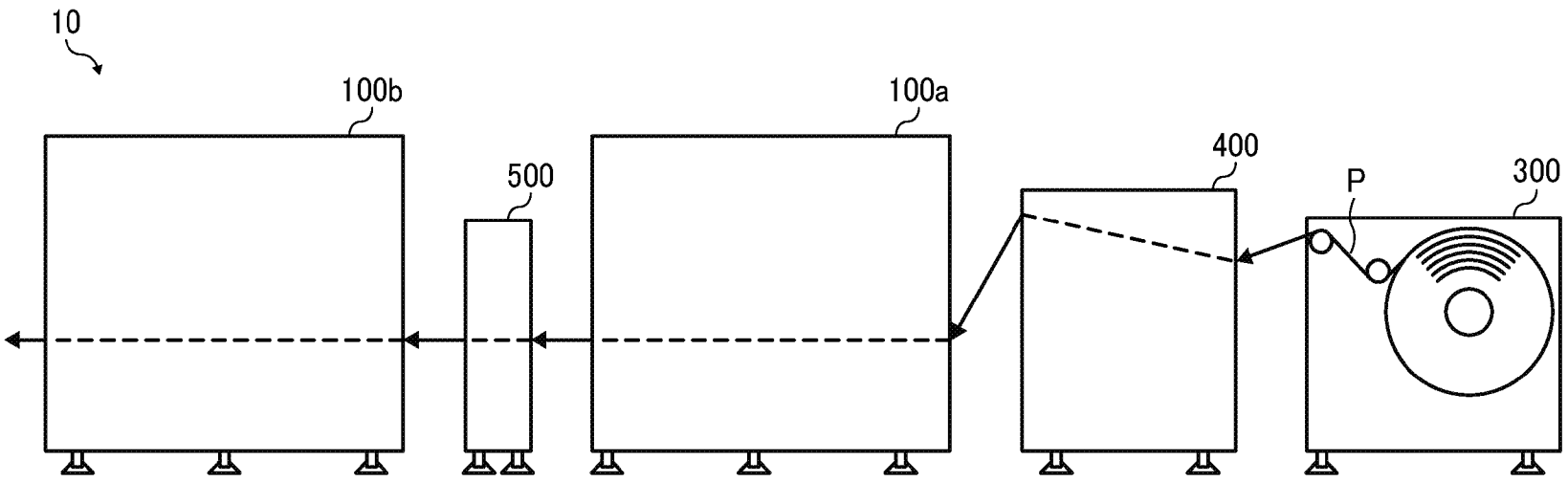
FIG. 1 is a schematic diagram illustrating a configuration of an image forming system according to Embodiment 1.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a"; "an", and "the" are intended to include the plural forms as well, unless the context clearly indicates otherwise.

Embodiment 1

Descriptions are given below of an embodiment in which a device (having a head) is a liquid discharge apparatus and a head of the processor is a liquid discharge head. In the description below, the device performs image formation.

[Image Forming System]

FIG. 1 is a schematic diagram illustrating an image forming system 10 according to Embodiment 1.

As illustrated in FIG. 1, the image forming system 10 includes a first image forming apparatus 100*a*, a second image forming apparatus 100*b*, a sheet feeder 300, a treatment agent applicator 400, and a reversing device 500. In Embodiment 1, the first image forming apparatus 100*a* and the second image forming apparatus 100*b* are examples of the liquid discharge apparatus and configured to eject ink droplets to form images on a sheets P. In the descriptions below, the first image forming apparatus 100*a* and the second image forming apparatus 100*b* may be collectively referred to as "image forming apparatuses 100".

The sheet feeder 300 feeds the sheet P, serving as a conveyed object, to the treatment agent applicator 400. The sheet P is a long, continuous sheet rolled and contained in the sheet feeder 300. The sheet feeder 300 includes a supply roller and the like to feed the sheet P to the treatment agent applicator 400. The treatment agent applicator 400 applies a treatment agent onto both sides (first and second sides) of the sheet P while transporting the sheet P toward the first image forming apparatus 100*a*.

The first image forming apparatus 100*a* discharges ink droplets from recording heads 101 (101K, 101C. 101M, and 101Y illustrated in FIG. 2) based on image data input thereto, to form an image on the first side of the sheet P, after the both sides of the sheet P are coated with the treatment agent in the treatment agent applicator 400.

After the image is formed on the first side thereof, the sheet P is ejected from the first image forming apparatus 100*a*. Then, the reversing device 500 reverses the sheet P upside down and feeds the sheet P to the second image forming apparatus 100*b*.

The second image forming apparatus 100*b* discharges ink droplets from the recording heads 101 based on image data input thereto, to form an image on the second side of the sheet P bearing the image on the first side thereof.

The image forming system 10 thus configured forms images on both sides of the sheet P, which is a long continuous sheet. Note that the image forming system 10 can include a cutter to cut the sheet P ejected from the second image forming apparatus 100*b*, a sheet processing apparatus for post processing of the cut sheet P, or both.

[Image Forming Apparatus]

Figure 2:
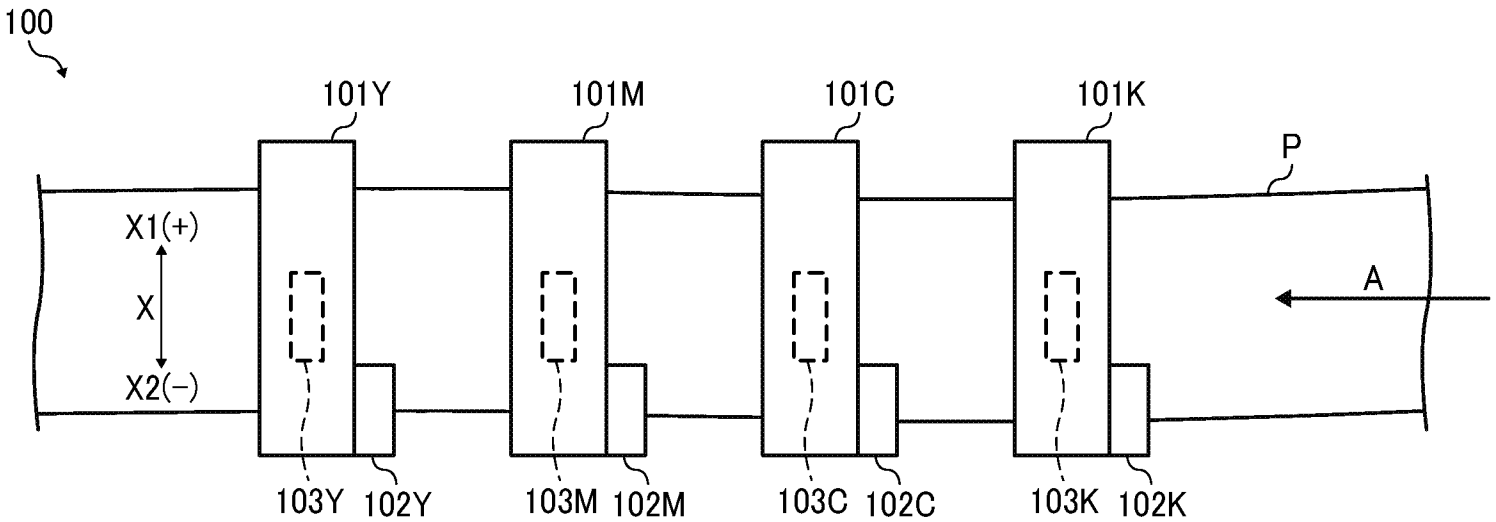
FIG. 2 is a schematic top view of a main structure of an image forming apparatus of the image forming system illustrated in FIG. 1.
Figure 3:
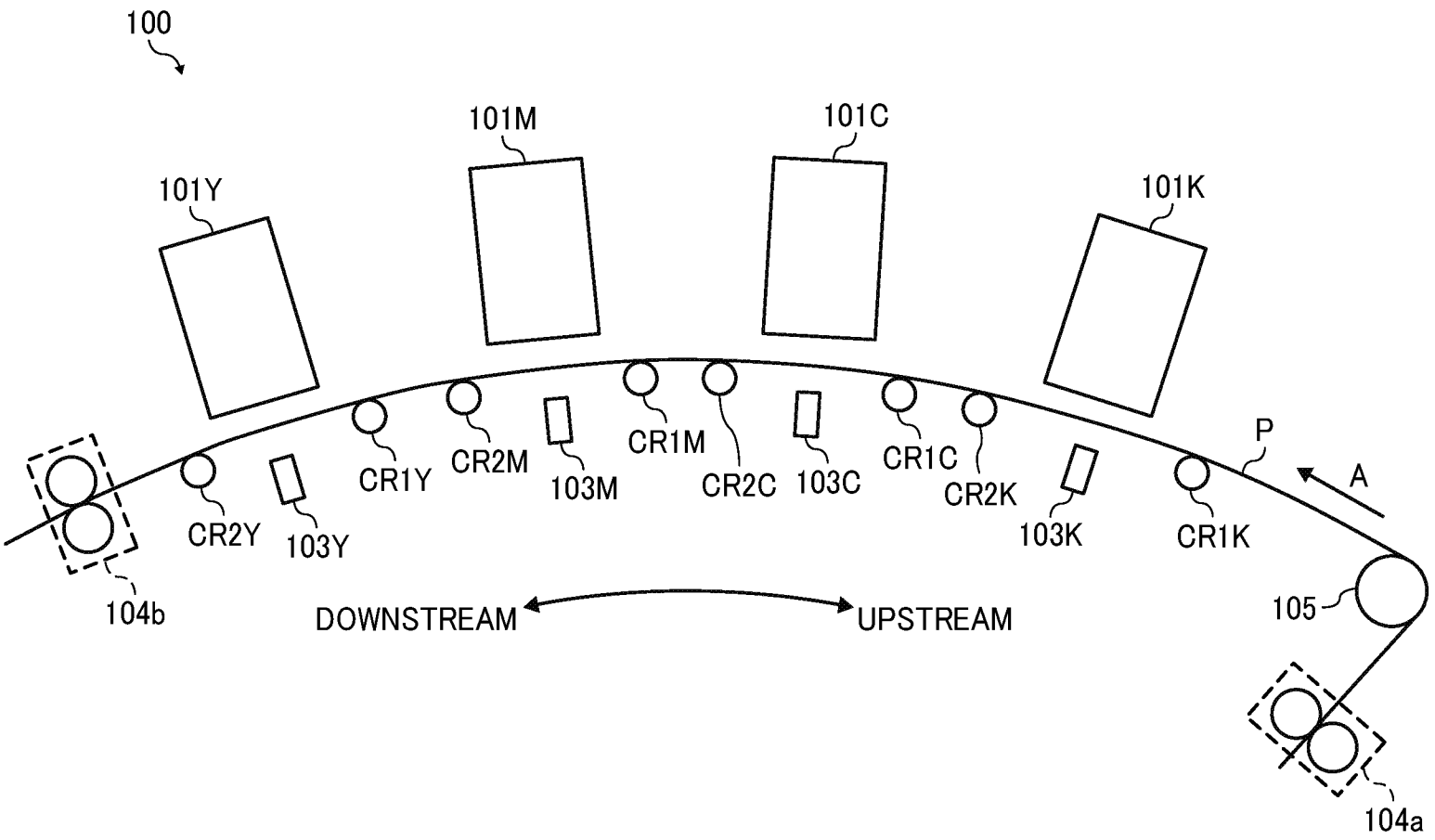
FIG. 3 is a schematic side view of the main structure of the image forming apparatus illustrated in FIG. 2.

FIG. 2 is a schematic top view of a main structure of the image forming apparatus 100 according to Embodiment 1. FIG. 3 is a schematic side view of the main structure of the image forming apparatus 100 according to Embodiment 1.

As illustrated in FIGS. 2 and 3, the image forming apparatus 100 includes the recording head 101K, the recording head 101C, the recording head 101M, and the recording head 101Y arranged, along a conveyance passage of the sheet P, in that order in a conveyance direction of the sheet P, indicated by arrow A in FIG. 1. Suffixes K, C, M, and Y represent black, cyan, magenta, and yellow, respectively.

The recording heads 101K, 101C, 101M, and 101Y (also collectively "recording heads 101") are examples of the liquid discharge head and are functional components to eject liquid from nozzles. For example, each of the recording heads 101K, 101C, 101M, and 101Y includes a piezoelectric actuator, as an energy source to generate energy and eject, from the nozzles, ink droplets of color represented by the suffix of the reference numeral. Examples of the energy source include a thermal actuator that uses a thermoelectric conversion element such as a heat element, and an electrostatic actuator including a vibration plate and an opposed electrode. The suffixes K, C, M, and Y representing the colors may be omitted in the description below.

The recording head 101 has a plurality of nozzles lined in a width direction perpendicular to the conveyance direction of the sheet P and can discharge ink droplets from the plurality of nozzles to form an image across the width direction of the sheet P while passing over the sheet P once (i.e., one pass). Note that the recording head 101 may be a recording head unit including a plurality of recording heads.

The recording heads 101 are moved by actuators 102 (102K, 102C, 102M, and 102Y), in the width direction perpendicular to the conveyance direction of the sheet P. The actuator 102 is one example of a head moving device. The actuator 102 includes, for example, a servo motor and converts the rotation of the servo motor into linear motion with a ball screw mechanism, thereby moving the recording head 101 in the width direction.

At a position opposing the recording head 101 via the sheet P, a sensor 103 (103K, 103C, 103M, or 103Y) is disposed. The sensor 103 includes, for example, a light-emitting element to emit laser light onto the sheet P and an image sensor to image a range of the sheet P irradiated with the laser light from the light-emitting element.

As the laser light emitted from the light-emitting element is diffused on the surface of the sheet P and superimposed diffusion waves interfere with each other, a pattern such as a speckle pattern appears on the image imaged by the image sensor of the sensor 103. Descriptions are given below of an example in which the pattern is a speckle pattern. Based on changes in position of the speckle pattern appearing on the image of the sheet P imaged by the image sensor, for example, the amount of movement of the sheet Pin the width direction can be obtained. Note that a light source of the sensor 103 may be a light emitting diode (LED) or an organic electroluminescence (EL). In this case, the amount of movement of the sheet P in the width direction is obtained based on a pattern caused by diffusion waves of the light emitted from the LED.

As illustrated in FIG. 3, conveyance rollers 104*a* and 104*b* (collectively "conveyance rollers 104") and a driven roller 105 convey the sheet P to pass between the recording heads 101 and the sensors 103. Further, a conveyance roller CR1 (CR1K, CR1C, CR1M, or CR1Y) and a conveyance roller CR2 (CR2K, CR2C, CR2M, or CR2Y) are disposed on the upstream side and the downstream side, respectively, of each recording head 101 (101K, 101C, 101M, or 101Y). Each of the conveyance rollers CR1 and CR2 may be a driving roller or a driven roller that rotates as the sheet P moves.

Note that, the conveyance rollers CR1 and. CR2 are examples of first and second supports to support the conveyed target. The first and second supports are not necessarily rotators such as driven rollers as long as the first and second can support the conveyed object. For example, each of the first and second supports can be a pipe or a shaft having a round cross section. Alternatively, each of the first and second supports can be a curved plate having an arc-shaped face to contact the conveyed object. In the description below, the conveyance rollers CR1K, CR1C, CR1M, and CR1Y serve as the first supports, and the conveyance rollers CR2K, CR2C, CR2M, and CR2Y serve as the second supports.

In this structure, the recording head 101 and the sensor 103 are preferably disposed such that an image formation area of the recording head 101 overlaps, at least partly, with a detection range of the sensor 103 in the conveyance direction of the sheet P, indicated by arrow A.

The image formation area, which is an example of an operation area in which the head performs operation, is an area (i.e., a liquid discharge area) in which the recording head 101 discharges ink droplets to form an image on the sheet P. The detection range is an image capturing area of the image sensor and includes an area irradiated with the laser light from the light-emitting element of the sensor 103. With this structure, the recording head 101 can be moved more accurately, in accordance with the position in the width direction of the sheet P. In the image forming apparatuses 100 according to the present embodiment, the sensor 103 is disposed between the conveyance roller CR1 upstream from the recording head 101 and the conveyance roller CR2 downstream from the recording head 101 in the conveyance direction of the sheet P. Since vibration of the sheet P is suppressed in an area between the conveyance rollers CR1 and CR2 disposed relatively close to each other, the sensor 103 can detect the sheet P reliably.

Note that, the sensor 103 is a sensor capable of detecting the position and the amount of movement of the sheet P in the width direction. For example, a contact image sensor (CIS) is disposed in a range in which an end of the sheet P in the width direction passes. Alternatively, the sensor 103 can be an edge sensor to contact an end of the sheet P to physically detect the position of the sheet end.

In the image forming apparatuses 100, according to the amount of movement of the sheet P in the width direction, obtained based on the output from the sensor 103, the actuator 102 moves the recording head 101 in accordance with the position of the sheet P. As the recording head 101 moves according to the position of the sheet P, misalignment between the position of the sheet P and the image forming position is suppressed. Accordingly, the image forming apparatuses 100 can inhibit images from being out of color registration to form high quality images.

[Hardware Configuration]

Figure 4:
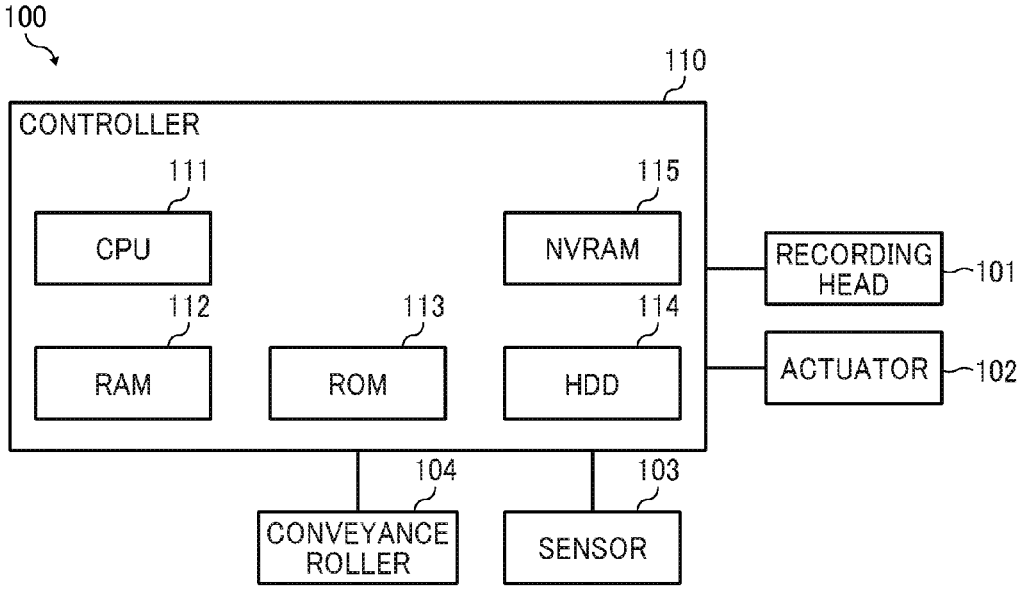
FIG. 4 is a block diagram illustrating a hardware configuration of the image forming apparatus according to Embodiment 1.

FIG. 4 is a block diagram illustrating a hardware configuration of the image forming apparatus 100 according to Embodiment 1.

As illustrated in FIG. 4, the image forming apparatus 100 includes the recording heads 101, the actuators 102, the sensors 103, the conveyance rollers 104, and a controller 110.

The recording head 101 discharges ink droplets onto the sheet P based on the image data input to the image forming apparatus 100, thereby forming an image. As described above, the image forming apparatus 100 includes the recording heads 101 to form yellow, magenta, cyan, and black images, respectively, and superimposes the different color images to form a full-color image.

Controlled by the controller 110, the actuator 102 moves the recording head 101 in the width direction orthogonal to the conveyance direction of the sheet P. The sensor 103 includes the light-emitting element and the image sensor and transmits, to the controller 110, the data of a captured image obtained in a predetermined sampling period.

For example, the conveyance rollers 104 each are roller pairs in which one roller is a driving roller and the other roller is a driven roller. The conveyance rollers 104 convey the sheet P along the conveyance passage. An encoder is attached to a rotation shaft of one roller in the roller pair serving as the conveyance rollers 104. The encoder transmits a conveyance signal to the controller 110 each time the conveyance rollers 104 conveys the sheet P by a predetermined distance.

The controller 110 includes a central processing unit (CPU) 111, a random access memory (RAM) 112, a read only memory (ROM) 113, a hard disk drive (HDD) 114, and a non-volatile random access memory (NV RAM) 115, The ROM 113 stores a variety of programs and data used by the programs. The RAM 112 is used as a memory area for loading the programs and a work area of the loaded programs. The CPU 111 processes the programs loaded in the RAM 112 to implement a variety of functions.

The controller 110 controls the recording heads 101, based on the image data, and causes the recording head 101 to discharge ink droplets from the nozzles thereof to form an image on the sheet P. Further, the controller 110 computes, based on the output from the sensor 103, the position of the sheet P in the width direction and a meandering speed (the speed of movement of the sheet P in the width direction). The controller 110 controls the actuator 102 so that the recording head 101 moves in accordance with the position of the sheet P.

[Functional Configuration]

Figure 5:
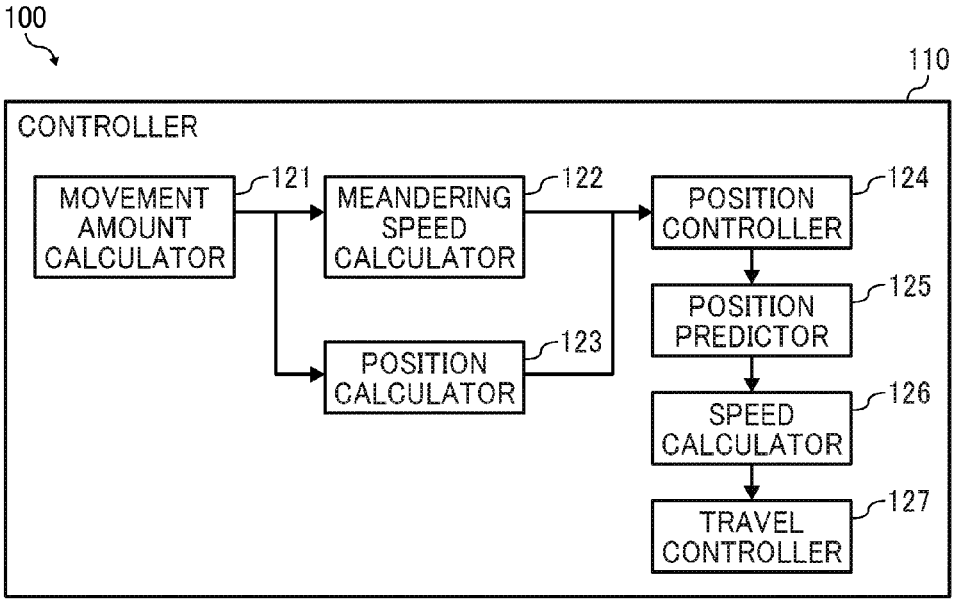
FIG. 5 is a functional block diagram of the image forming apparatus according to Embodiment 1.

FIG. 5 is a functional block diagram of the controller 110 of the image forming apparatus 100 according to Embodiment 1.

As illustrated in FIG. 5, the controller 110 includes a movement amount calculator 121, a meandering speed calculator 122, a position calculator 123, a position controller 124, a position predictor 125, a speed calculator 126, and a travel controller 127. The respective functions of the above-described parts of the controller 110 are implemented by the processing performed by the CPU 111 according to at least one program installed in the image forming apparatus 100.

The movement amount calculator 121 calculates the amount of movement of the sheet P in the width direction, based on the image captured by the image sensor of the sensor 103. The sensor 103 outputs, in the predetermined sampling period, data of the image captured by the image sensor.

As described above, the speckle pattern in the captured image changes with tome, as the sheet P conveyed by conveyance rollers 104 moves in the conveyance direction and the width direction. The movement amount calculator 121 calculates a width-direction movement amount $\Delta dW$ of the sheet P in the sampling period, based on the amount of displacement of the speckle pattern in the captured image output from the sensor 103.

For example, in the width direction indicate by arrow X illustrated in FIG. 2, when the sheet P moves in the direction indicated by arrow X1 (one direction of the width direction, hereinafter "direction X1") in the detection range of the sensor 103, the width-direction movement amount $\Delta dW$ is a positive value. When the sheet P moves in the direction indicated by arrow X2 (hereinafter "direction X2"), the width-direction movement amount $\Delta dW$ is a negative value.

The meandering speed calculator 122 calculates a meandering speed dWs of the sheet P (the speed of movement of the sheet in the width direction X) in the sampling period of the sensor 103, based on the width-direction movement amount $\Delta dW$ of the sheet P, obtained by the movement amount calculator 121. The meandering speed calculator 122 divides, with the sampling period, the width-direction movement amount $\Delta dW$ obtained by the movement amount calculator 1211 to calculate the meandering speed dWs of the sheet P (i.e., moving speed in the width direction).

For example, in the detection range of the sensor 103, when the sheet P moves in the direction X1 of the width direction X illustrated in FIG. 2, the meandering speed dWs is a positive value. When the sheet P moves in the direction X2, the meandering speed dWs is a negative value. The sensor 103, the movement amount calculator 121, and the meandering speed calculator 122 together function as a meandering speed detector to detect the meandering speed of the sheet P.

The position calculator 123 calculates the position of the sheet P in the width direction X. For example, in a state in which alignment of the recording head 101 and alignment of the sheet P are performed before conveyance of the sheet P is started, the position calculator 123 calculates the width-direction position dW as zero. Subsequently, the position calculator 123 sequentially adds, to the width-direction position dW, the width-direction movement amount ΔdW calculated by the movement amount calculator 121 in each sampling period of the sensor 103, thereby obtaining the width-direction position dW (i.e., a current position) at that time.

For example, in the width direction X illustrated in FIG. 2, when the sheet P is located downstream from an initial position (the position of the sheet P at the start of sheet conveyance) in the direction X1 in the detection range of the sensor 103, the width-direction position dW is a positive value. When the sheet P is located downstream from the initial position in the direction X2, the width-direction position dW is a negative value. The sensor 103, the movement amount calculator 121, and the position calculator 123 together function as a position detector to detect the position of the sheet in the width direction.

The position controller 124 instructs related portions to control the position of the recording head 101 in a predetermined control period. The predetermined control period is set to an integral multiple (not smaller than double) of the sampling period of the sensor 103. For example, when the sampling period of the sensor 103 is 100 μs, the predetermined control period is set to 200 μs, 400 μs, 600 μs, or the like.

Similarly, when the sampling period of the sensor 103 is set with reference to the distance of the sheet P conveyed, the predetermined control period is set to an integral multiple of the sampling period, not smaller than double of the sampling period. When the sampling period is 0.5 inch, the predetermined control period is set to 1 inch, 2 inches, 4 inches, or the like. In this case, control is performed according to the conveyance signal output from the encoder of the conveyance rollers 104.

The position predictor 125 calculates a predicted width position dW' of the sheet P in the sheet P based on the meandering speed dWs of the sheet P obtained by the meandering speed calculator 122, for each control period for controlling the position of the recording head 101. Specifically, the position predictor 125 calculates the predicted width position dW of the sheet P after the sheet P moves at the meandering speed dWs for a predetermined period. The position predictor 125 calculates the predicted width position dW' according to Formula 1 below, using the current width-direction position dW of the sheet P, the meandering speed dWs of the sheet P, and the predetermined period Δt.

$$dW'=dW+dWs\times\Delta t \qquad \text{Formula 1}$$

The predetermined period Δt is set to a period not shorter than the predetermined control period for controlling the position of the recording head 101. For example, when the predetermined control period is 200 μs, the predetermined period Δt is equal to or greater than 200 μs. Alternatively, when the predetermined control period is set with reference to, for example, the distance of the sheet P conveyed, the predetermined period Δt is set to a period not shorter than the time for the sheet P to be conveyed for a given distance (e.g., 1 inch).

The speed calculator 126 calculates, for each control period, a speed dHs with which the recording head 101 is conveyed so that the position of the recording head 101 after elapse of the predetermined period Δt matches with the predicted width position dW' of the sheet P, obtained by the position predictor 125. The speed calculator 126 calculates the speed dHs of the recording head 101 according to Formula 2, using the predicted width position dW' obtained by the position predictor 125, a position dH of the recording head 101, and the predetermined period Δt.

$$dHs=(dW'-dH)/\Delta t \qquad \text{Formula 2}$$

Note that, for example, in a state in which alignment of the recording head 101 and that of the sheet P are performed before conveyance of the sheet P is started, the position dH o the recording head 101 is zero, similar to the width-direction position dW of the sheet P. Additionally, for each control period, the travel amount of the recording head 101 in an immediately preceding control period is added to a previous position dH of the recording head 101, and thus the position dH represents a current position of the recording head 101.

The travel controller 127 controls the actuator 102 to move the recording head 101 at the speed dHs calculated by the speed calculator 126. When the calculated speed dHs is a positive value, the travel controller 127 controls the actuator 102 to move the recording head 101 in the direction X1 in the width direction illustrated in FIG. 2. When the calculated speed dHs is a negative value, the travel controller 127 controls the actuator 102 to move the recording head 101 in the direction X2 in the width direction illustrated in FIG. 2.

In the image forming apparatus 100, since the actuator 102 is controlled to move the recording head 101 in response to the position of the sheet P as described above, misalignment between the recording head 101 and the sheet P in the width direction is suppressed. In this state, the image forming apparatuses 100 can form high quality images.

Note that, for example, at least one of the movement amount calculator 121, the meandering speed calculator 122, and the position calculator 123 may be disposed in the sensor 103.

[Head Position Control]

Descriptions are given below of examples (Examples 1 and 2) of the position control of the recording head 101 in the image forming apparatus 100, according to Embodiment 1. When the conveyance of the sheet P is started, the image forming apparatus 100 performs the control processing described below to move the recording head 101 in response to the position of the sheet P.

EXAMPLE 1

Figure 6:
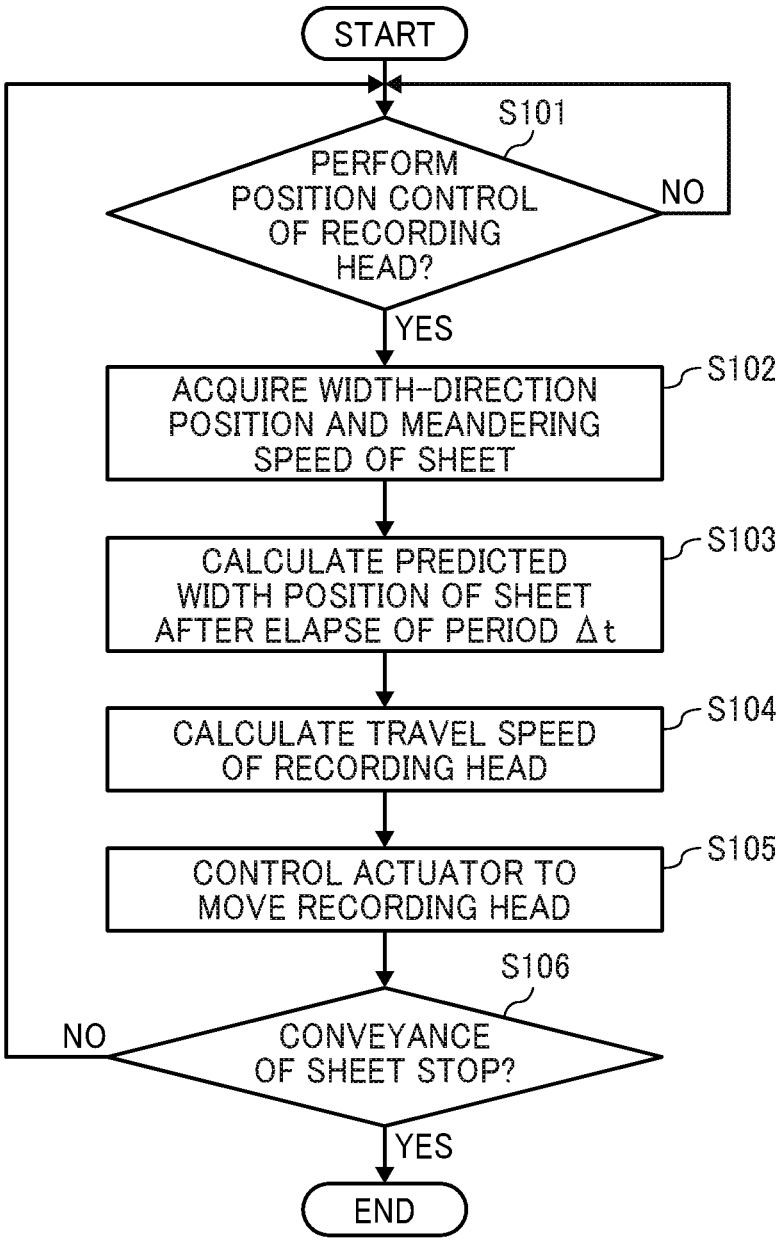
FIG. 6 is a flowchart of example position control according to Embodiment 1.

FIG. 6 is a flowchart of the position control according to Example 1 of Embodiment 1, In the position control according to Example 1, at S101, the position controller 124 determines whether to perform the position control of the recording head 101. The position controller 124 instructs the related portions to perform the process starting at S102 in the predetermined control period.

At S102, the position controller 124 acquires the width-direction position dW of the sheet P from the position calculator 123 and acquires the meandering speed dWs of the sheet P from the meandering speed calculator 122. As described above, the meandering speed calculator 122 and the position calculator 123 calculate, in the sampling period of the sensor 103, the meandering speed dWs and the width-direction position dW of the sheet P based on the image captured by the image sensor.

At S103, the position predictor 125 calculates the predicted width position dW' of the sheet P in the width direction, that is, the predicted width position dW' after elapse of the predetermined period Δt. The position predictor 125 calculates the predicted width position dW' of the sheet P according to Formula 1, using the width-direction position dW and the meandering speed dWs of the sheet P, which the position controller 124 acquires from the position calculator 123 and the meandering speed calculator 122, respectively.

At S104, the speed calculator 126 calculate the speed dHs with which the recording head 101 travels so that the position dH of the recording head 101 after elapse of the predetermined period At matches the predicted width position dW' of the sheet P. The speed calculator 126 calculates the speed dHs of the recording head 101 according to Formula 2.

At S105, the travel controller 127 controls the actuator 102 to move the recording head 101 in the width direction at the speed dHs calculated by the speed calculator 126.

At S106, position controller 124 determines whether or not the conveyance of the sheet P is stopped. When the sheet conveyance continues (No at S106), the process starting from S101 is repeated. When the sheet conveyance is stopped (Yes at S106), the controller 110 completes the position control.

In the above-described position control, the recording head 101 is moved toward the predicted width position dW' of the sheet P for each control period. Accordingly, the actuator 102 moves the recording head 101 in response to the meandering of the sheet P.

Figure 7A:
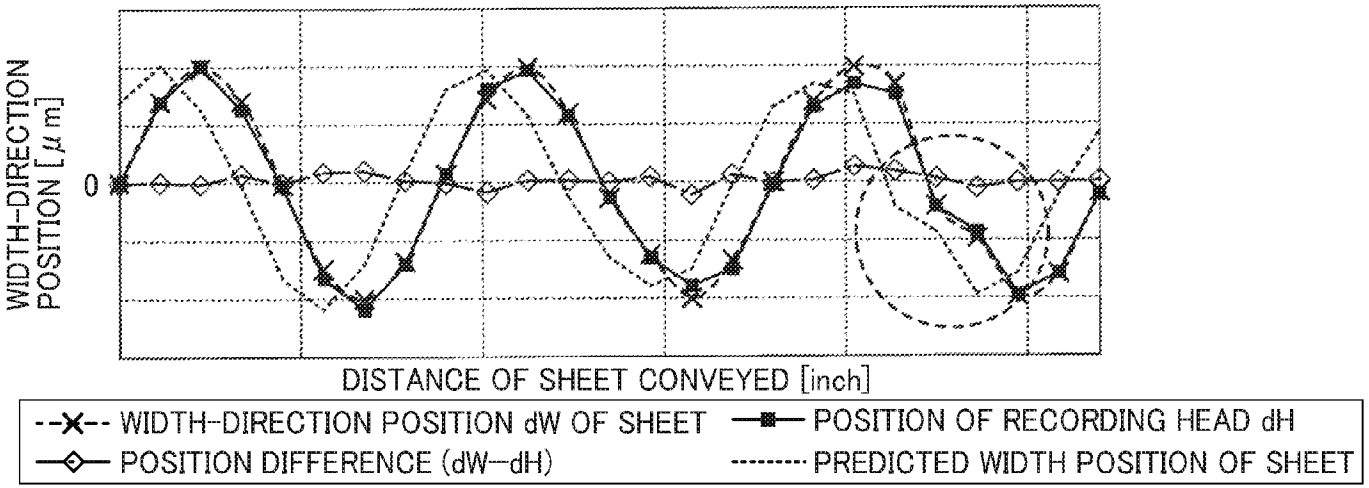
FIGS. 7A and 7B are graphs of results of the position control illustrated in FIG. 6.
Figure 7B:
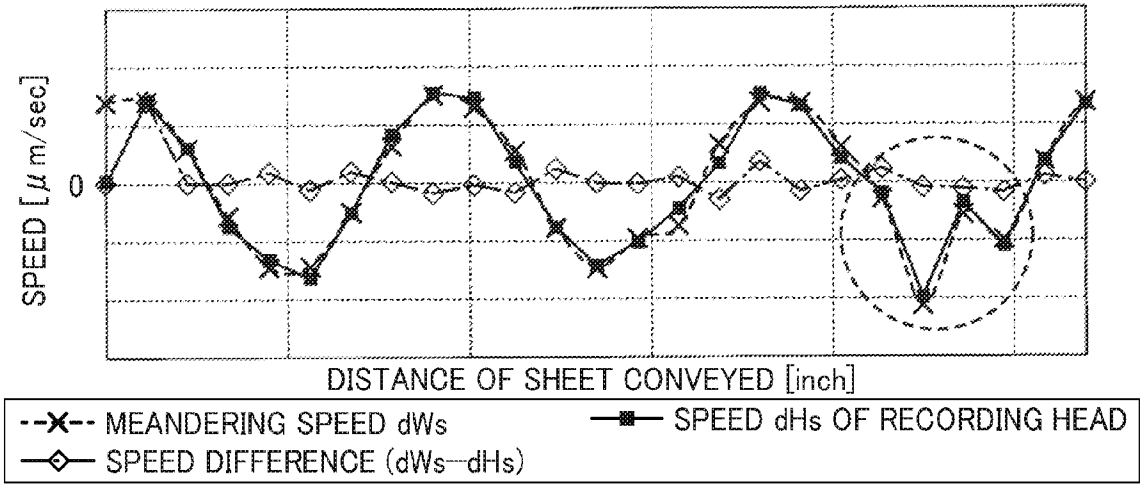

FIGS. 7A and 7B are graphs of results of the position control according to Example 1.

In the graph illustrated in FIG. 7A, the abscissa represents the distance of the sheet P conveyed, and the ordinate represents the position in the width direction. In FIG. 7A, the width-direction position dW, the position dH of the recording head 101, and the difference (dW−dH) in the width direction between the sheet P and the recording head 101, and the predicted width position dW' are presented.

In the graph illustrated in FIG. 7B, the abscissa represents the distance of the sheet P conveyed, and the ordinate represents the speed (or the meandering speed). In FIG. 7B, the speed this of the recording head 101, the meandering speed dWs of the sheet P, and the difference (dWs−dHs) between the speed dHs and the meandering speed dWs are presented.

In the position control according to Example 1, for each control period, the position predictor 125 calculates the predicted width position dW of the sheet P, and the recording head 101 is moved toward the predicted width position dW'. With such position control processing, as illustrated in FIG. 7A, the recording head 101 moves in accordance with the meandering sheet P. Accordingly, such position control processing reduces the difference between the position of the recording head 101 and the width-direction position dW of the sheet P. Further, as illustrated in FIG. 7B, the meandering speed dWs of the sheet P is approximately identical to the speed dHs of the recording head 101. That is, the difference therebetween is reduced.

Further, as in the portions enclosed with respective broken circles in FIGS. 7A and 7B, even when the sheet P moves irregularly, the recording head 101 follows the irregular movement of the sheet P.

As described above, in the position control according to Example 1, the actuator 102 moves the recording head 101 in accordance with the position of the meandering sheet P in the width direction. Thus, misalignment between the recording head 101 and the sheet P in the width direction are suppressed. In this state, image forming apparatuses 100 can form high quality images.

The above-described position control is performed for each of the recording heads 101K, 101C, 101M, and 101Y. Since the misalignment between the image forming position of the recording head 101 and the position of the sheet P in the width direction is suppressed, in this state, image forming apparatuses 100 can enhance the accuracy in superimposition of different colors (color registration) and form high quality images.

EXAMPLE 2

Figure 8:
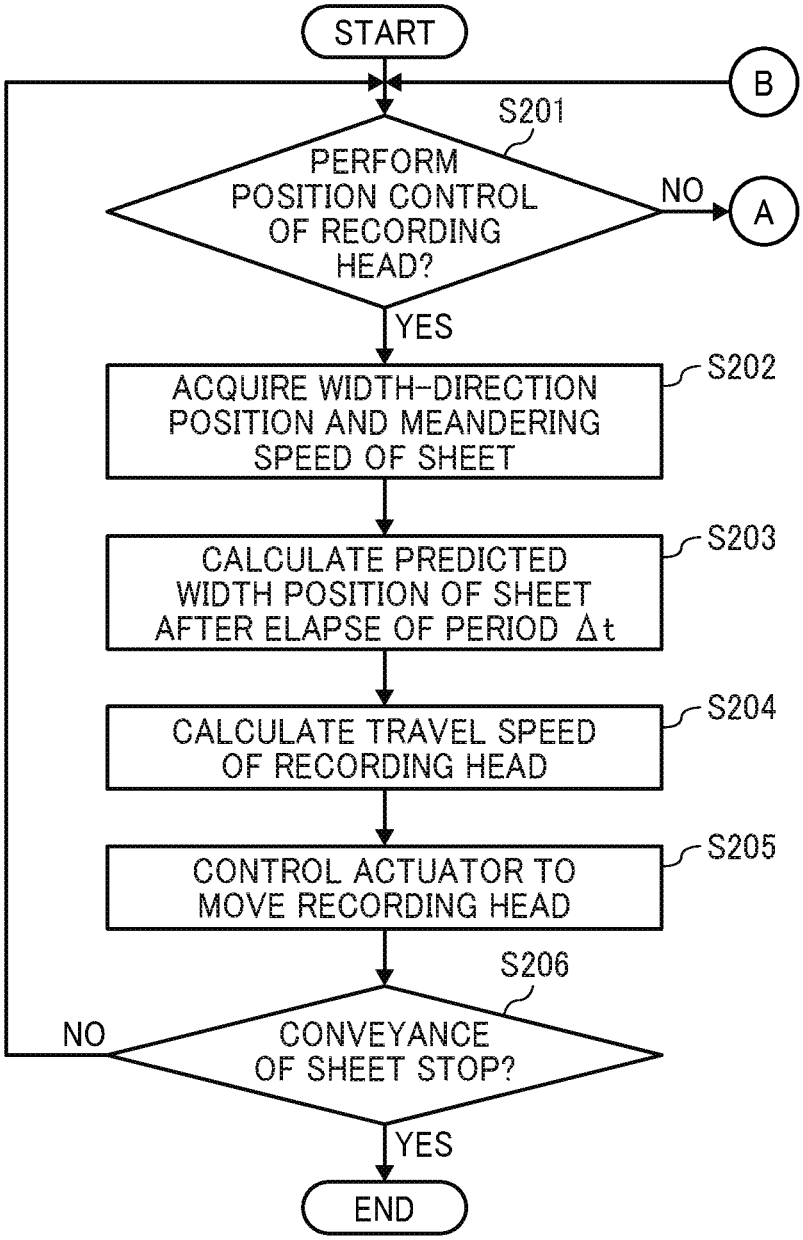
FIG. 8 is a flowchart of another example position control according to Embodiment 1.
Figure 9:
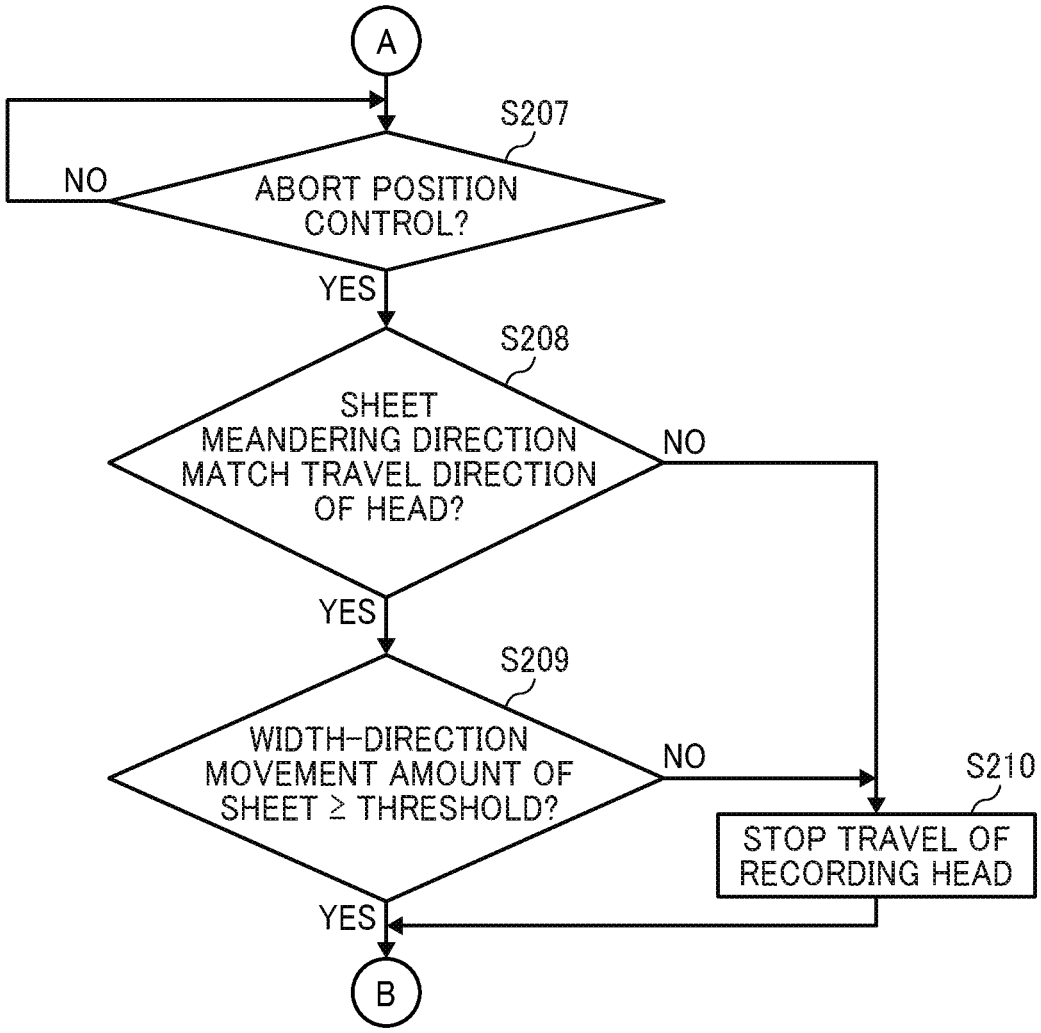
FIG. 9 is a flowchart of process following the process of the position control illustrated in FIG. 8.

FIGS. 8 and 9 are flowcharts of the position control according to Example 2.

In the position control according to Example 2, at 5201, the position controller 124 determines whether to perform the position control of the recording head 101. The position controller 124 instructs the position calculator 123, the meandering speed calculator 122, and the like to perform the process starting at S202, at the preset control period. The steps from S202 to S206 are similar to the steps from S102 to S106 of the position control according to Example 1. Thus, redundant descriptions thereof are omitted.

When the position control is not performed (No at S201), the process proceeds to S207 in FIG. 9.

At S207, the position controller 124 determines whether to abort the position control of the recording heads 101 (i.e., aborting processing). The position controller 124 starts the process starting at S208 at a predetermined aborting processing period. The aborting processing period is set to an integral multiple of the sampling period of the sensor 103 and shorter than the control period.

At S208, the position controller 124 checks whether the meandering direction of the sheet P (the direction of movement in the width direction) matches the travel direction of the recording head 101. The position controller 124 determines a latest direction of movement of the sheet P in the width direction, based on the travel amount of the sheet P, calculated by the movement amount calculator 121 in the sampling period of the sensors 103. Further, the position controller 124 checks whether or not the direction of movement of the sheet P matches (e.g., not reverse to) the travel direction of the recording heads 101 controlled by the travel controller 127.

When the direction of movement of the sheet P is reverse to the travel direction of the recording head 101 (No at S208), the process proceeds to Step S210. The travel controller 127 instructs the actuator 102 to stop the recording head 101.

Thus, when the direction of movement of the sheet P changes and the recording head 101 moves to the direction reverse to the direction of movement of the sheet P, the recording head 101 is stopped, thereby inhibiting aggravation of misalignment between the sheet P and the recording head 101.

When the direction of movement of the sheet P matches the travel direction of the recording heads 101 (Yes at S208), the process proceeds to Step S209. At S209, the position controller 124 compares the width-direction movement amount of the sheet P with a threshold set according to the meandering speed calculated by the meandering speed calculator 122.

Specifically, compared with the threshold at S209 is the amount of movement of the sheet P in the width direction in a period from when the position control of the recording head 101 (Steps S202 to S205) is performed until the aborting processing (Steps S208 and S209) is performed.

The threshold used in the comparison at S209 is, for example, the half of an estimated movement amount by which the sheet P is expected to move from when the position control is started until the aborting processing is performed, on the assumption that the sheet P moves at the meandering speed calculated by the meandering speed calculator 122. Note that the threshold is not limited to the above-mentioned example but can be a given value not greater than the estimated movement amount.

When the width-direction movement amount of the sheet P is smaller than the threshold (No at S209), the process proceeds to Step 5210. The travel controller 127 causes the actuator 102 to stop the recording head 101.

Thus, when the width-direction movement amount of the sheet P is smaller than the threshold, the travel amount of the recording head 101 exceeds the width-direction movement amount of the sheet P. Then, the misalignment in position between the recording head 101 and the sheet P may increase. Therefore, the recording head 101 is stopped moving in the width direction to inhibit aggravation of misalignment between the sheet P and the recording head 101.

Note that, when the width-direction movement amount of the sheet P is greater than the estimated movement amount of the sheet P, subsequent position control is performed so that the recording head 101 catches up the sheet P to eliminate the misalignment.

When the width-direction movement amount of the sheet P is equal to or greater than the threshold (Yes at S209), or after the recording head 101 is stopped moving at S210, the process returns to Step S201 in FIG. 8.

As described above, in the position control according to Example 2, the actuator 102 moves the recording head 101 in accordance with the position of the meandering sheet P in the width direction. Thus, misalignment between the recording head 101 and the sheet P in the width direction is suppressed. Accordingly, high quality images can be produced. Additionally, when the direction and the amount of movement of the sheet P changes, travelling of the recording head 101 is stopped to inhibit aggravation of misalignment between the sheet P and the recording head 101. Accordingly, image quality can be secured.

COMPARATIVE EXAMPLE 1

Next, descriptions are given below of position control of the recording head 101 according to Comparative example 1.

In the position control according to Comparative example 1, for each control period, the actuator 102 is controlled such that the position of the recording head 101 in a subsequent control period matches a current position of the sheet P in the width direction. The position control according to Comparative example 1 is so-called feedback control, and the recording head 101 is controlled to follow the movement of the sheet P meandering.

Figure 10A:
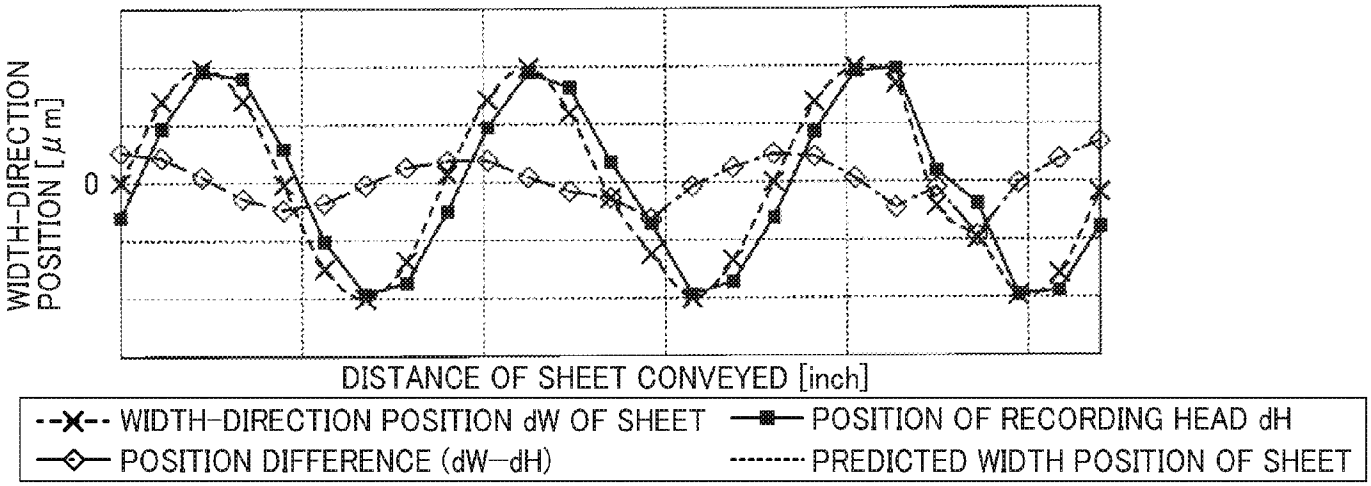
Figure 10B:
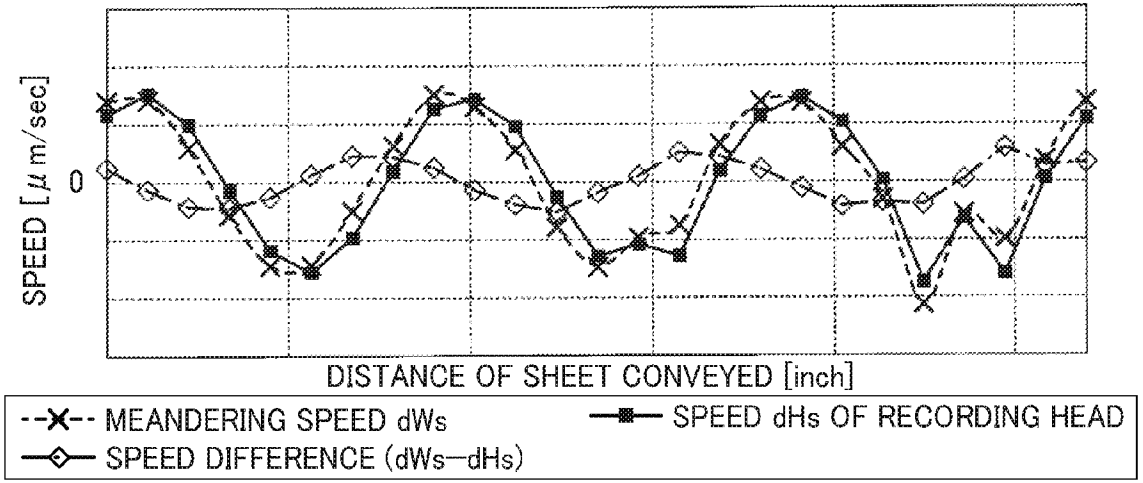

FIGS. 10A and 10B are graphs illustrating results of position control according to Comparative example 1.

In the graph illustrated in FIG. 10A, the abscissa represents the distance of the sheet P conveyed, and the ordinate represents the position in the width direction. FIG. 10A illustrates the width-direction position dW of the sheet P, the position dH of the recording head 101, and the difference (dW−dH) in the width direction between the sheet P and the recording head 101, and the predicted width position dW' of the sheet P.

In the graph illustrated in FIG. 10B, the abscissa represents the distance of the sheet P conveyed, and the ordinate represents travel speed (or meandering speed). FIG. 10B illustrate the speed dHs of the recording head 101, the meandering speed dWs of the sheet P, and the difference (dWs−dHs) between the speed dHs and the meandering speed dWs.

In the position control according to Comparative example 1, the recording head 101 moves, following the sheet P. Accordingly, as illustrated in FIGS. 110A and 110B, a difference arises between the width-direction position dW of the sheet P and the position dH of the recording head 101, like a phase shift, in accordance with the control period. Accordingly, the difference between the width-direction position dW of the sheet P and the position dH of the recording head 101, illustrated in FIG. 10A, increases. Similarly, the difference between the meandering speed dWs of the sheet P and the speed dHs of the recording head 101, illustrated in FIG. 10B, increases.

COMPARATIVE EXAMPLE 2

Next, descriptions are given below of position control of the recording head 101 according to Comparative example 2.

In the position control according to Comparative example 2, positional fluctuations, in one control period, of the sheet P meandering periodically is predicted, and the position of the sheet P is predicted based on the predicted positional fluctuations. The recording head 101 is moved in accordance with the predicted position of the sheet P. The position control according to Comparative example 2 is so-called feed-forward control. The positional fluctuations in one control period of the meandering sheet P are predicted, and the recording head 101 is moved together with the sheet P.

Figure 11A:
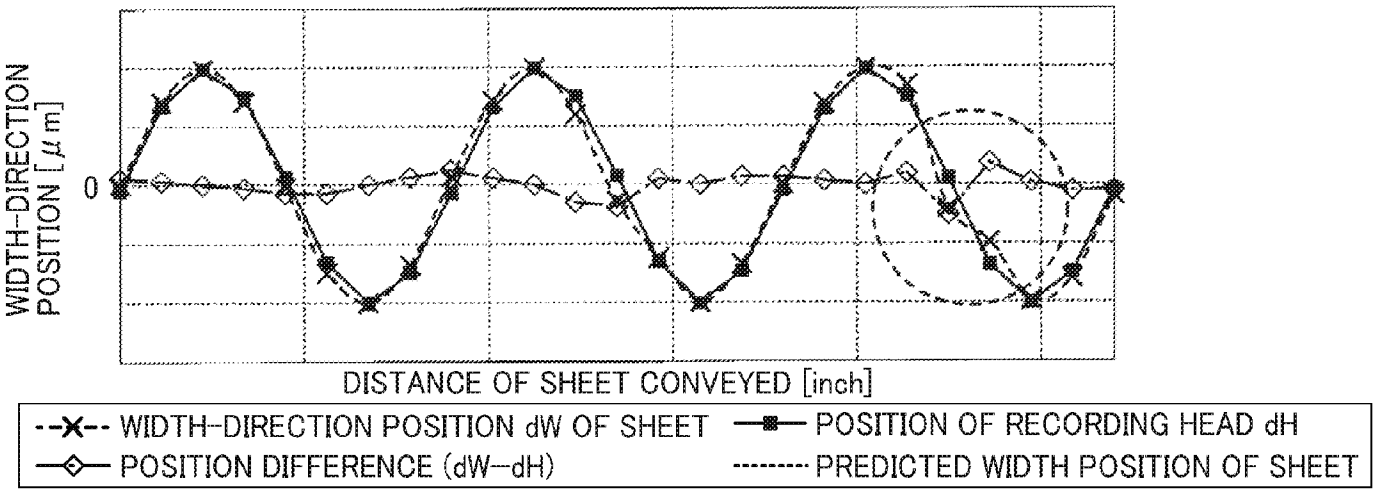
FIGS. 11A and 11B are graphs of results of the position control according to Comparative example 2.
Figure 11B:
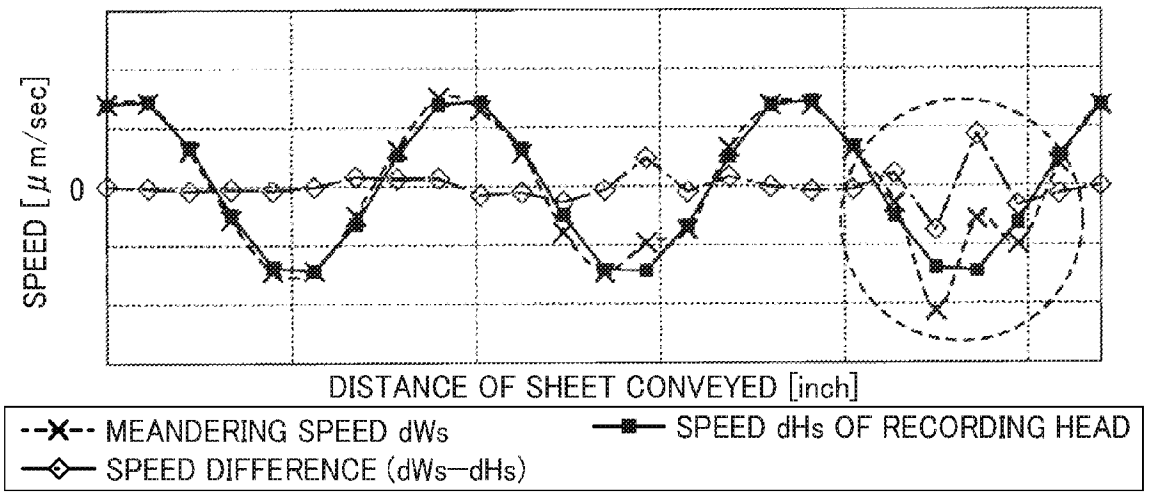

FIGS. 11A and 11B are graphs illustrating results of position control according to Comparative example 2.

In the graph illustrated in FIG. 11A, the abscissa represents the distance of the sheet P conveyed, and the ordinate represents the position in the width direction. FIG. 11A illustrates the width-direction position dW of the sheet P, the position dH of the recording head 101, and the difference (dW−dH) in the width direction between the sheet P and the recording head 101, and the predicted width position dW' of the sheet P.

In the graph illustrated in FIG. 11B, the abscissa represents the distance of the sheet P conveyed, and the ordinate represents travel speed (or meandering speed). FIG. 11B illustrate the speed dHs of the recording head 101, the meandering speed dWs of the sheet P, and the difference (dWs−dHs) between the speed dHs and the meandering speed dWs.

In the position control according to Comparative example 2, while the sheet P meanders as predicted, the width-direction position dW of the sheet P approximately matches the position dH of the recording head 101, with the difference therebetween reduced. In the portions enclosed with broken circles in FIGS. 11A and 11B, however, if the sheet P irregularly moves in a direction other than the predicted direction, the recording head 101 fails to follow the movement of the sheet P. Then, the differences in position and speed between the sheet P and the recording head 101 increase.

As described above, in the image forming apparatuses 100 according to Embodiment 1, the recording head 101 is controlled to move toward the predicted width position of the sheet P, acquired for each control period. Accordingly, misalignment between the recording head 101 and the sheet P can be reduced, which contributes to high-quality images. Additionally, even when the sheet P moves irregularly, the misalignment between the sheet P and the recording head 101 in the width direction can be reduced to secure image quality.

Embodiment 2

Next, Embodiment 2 is described below with reference to drawings. Note that descriptions of elements identical or similar to those of above-described embodiments are omitted to avoid redundancy.

Figure 12:
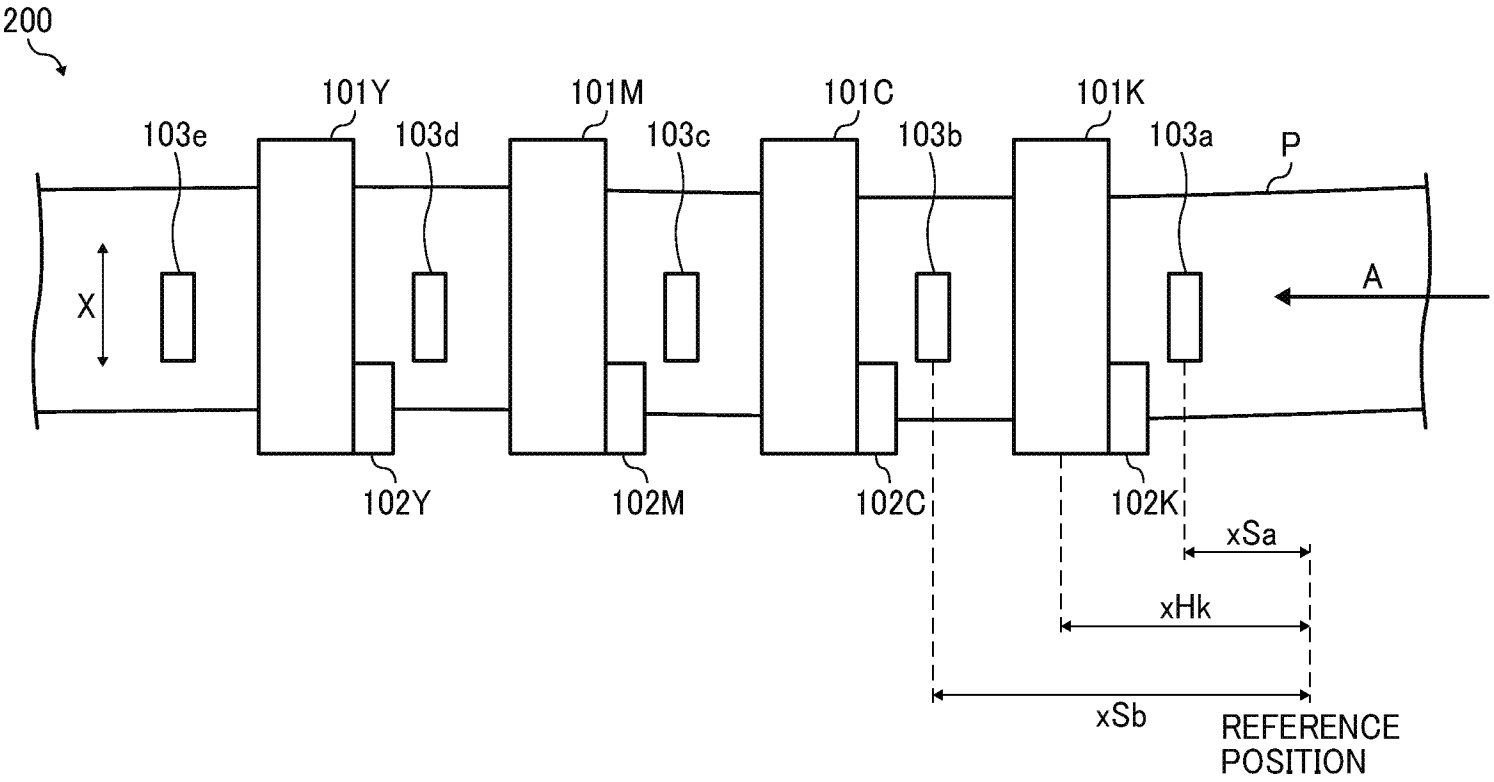
FIG. 12 is a schematic top view of a main structure of an image forming apparatus according to Embodiment 2.

FIG. 12 is a schematic diagram of a main part of an image forming apparatus 200 according to Embodiment 2.

As illustrated in FIG. 12, the image forming apparatus 200 according to Embodiment 2 includes the recording head 101K, the recording head 101C, the recording head 101M, and the recording head 101Y arranged, along the conveyance passage of the sheet P, in that order in the conveyance direction of the sheet P indicated by arrow A. The image forming apparatus 200 further includes the actuators 102 (102K, 102C, 102M, and 102Y) to move the recording heads 101 in the width direction.

The image forming apparatus 200 further includes a sensor 103*a* disposed upstream from the recording head 101K, a sensor 103*b* disposed between the recording head 101K and the recording head 101C, a sensor 103*c* disposed between the recording head 101C and the recording head 101M, a sensor 103*d* disposed between the recording head 101M and the recording head 101Y, and a sensor 103*d* disposed downstream from the sensors 103*e* in the conveyance direction of the sheet P. The sensors 103*a*, 103*b*, 103*c*, 103*d*, and 103*e* and the recording heads 101 are disposed on an identical side of the sheet P. The sensors 103*a*, 103*b*, 103*c*, 103*d*, and 103*e* are similar in configuration to the sensors 103 in Embodiment 1.

Descriptions are given below of calculation of a width-direction position dWk and a meandering speed dWsk of the sheet P in the image formation area of the recording head 101K.

Before conveyance of the sheet P is started, alignment of the recording head 101 and alignment of the sheet P are performed such that the width-direction position dWk of the sheet P and a position dHk of the recording head 101K are set to zero (dWk=0 and dHk=0). After the conveyance of the sheet P is started, the movement amount calculator 121 calculates a width-direction movement amount ΔdWa of the sheet P in the detection range of the sensor 103*a* and a width-direction movement amount ΔdWb of the sheet P in the detection range of the sensor 103*b*. Similar to Embodiment 1, the movement amount calculator 121 can calculate the width-direction movement amounts ΔdWa and ΔdWb based on changes in position of the speckle pattern on the images captured by the image sensors of the sensors 103*a* and 103*b*.

Using the width-direction movement amounts ΔdWa and ΔdWb thus obtained, a width-direction movement amount ΔdWk of the sheet P in the image formation area of the recording head 101K is obtained according to Formula 3 below.

$$\Delta dWk=(\Delta dWb-\Delta dWa)/(xSb-xSa)\times xHk \qquad \text{Formula 3}$$

In Formula 3, as illustrated in FIG. 12, xSa represents a distance from a reference position to the detection range of the sensor 103*a* in the conveyance direction of the sheet P indicated by arrow A. Similarly, xSb represents a distance from the reference position to the detection range of the sensor 103*b* in the conveyance direction of the sheet P, and xHk represents a distance from the reference position to the image formation area of the recording head 101K in the conveyance direction of the sheet P. The reference position is set to, for example, a given position upstream from the sensor 103*a*.

For each of the respective sampling periods of the sensors 103*a* and 103*b*, the movement amount calculator 121 calculates the width-direction movement amount ΔdWk of the sheet P in the image formation area of the recording head 101K, according to Formula 3. The position calculator 123 sequentially adds the width-direction movement amount ΔdWk to the width-direction position dWk. Thus, the position calculator 123 obtains the width-direction position dWk, as a current position of the sheet Pin the image formation area of the recording head 101K.

The meandering speed calculator 122 divides the width-direction movement amount ΔdWk with the sampling period of the sensors 103*a* and 103*b*, thereby calculating the meandering speed dWsk of the sheet P in the image formation area of the recording head 101K.

Similar to Formula 3, a width-direction position dWc and a meandering speed dWsc of the sheet P in the image formation area of the recording head 101C are obtained, using the width-direction movement amounts ΔdWb and ΔdWc of the sheet P respectively in the detection ranges of the sensors 103*b* and 103*c*. Similar to Formula 3, a width-direction position dWm and a meandering speed dWsm of the sheet P in the image formation area of the recording head 101M are obtained, using the width-direction movement amounts ΔdWc and ΔdWd of the sheet P respectively in the detection ranges of the sensors 103*c* and 103*d*. Similar to Formula 3, a width-direction position dWy and a meandering speed dWsy of the sheet P in the image formation area of the recording head 101Y are obtained, using the width-direction movement amounts ΔdWd and ΔdWe of the sheet P respectively in the detection ranges of the sensors 103*d* and 103*e*.

In the image forming apparatuses 200 according to Embodiment 2, as described above, the movement amount calculator 121 calculates the width-direction position of the sheet P and the meandering speed calculator 122 calculates the meandering speed of the sheet P in the image formation area of each recording head 101, thereby performing the position control similar to that according to Embodiment 1. Accordingly, the image forming apparatus 200 can reduce the misalignment between the sheet P and the image forming positions of the recording heads 101 to obtain high-quality images.

As described above, in the image forming apparatus 200 according to Embodiment 2, even in the arrangement in which the sensors 103 and the recording heads 101 are disposed on an identical side of the sheet P, the misalignment between the sheet P and the recording heads 101 can be reduced. Accordingly, images can be inhibited from being out of color registration, and high image quality can be secured. Note that the calculation of the width-direction position dW and the meandering speed dWs of the sheet P in the image formation area of each recording head 101 is not limited to the method described above.

[Variation]

Figure 13:
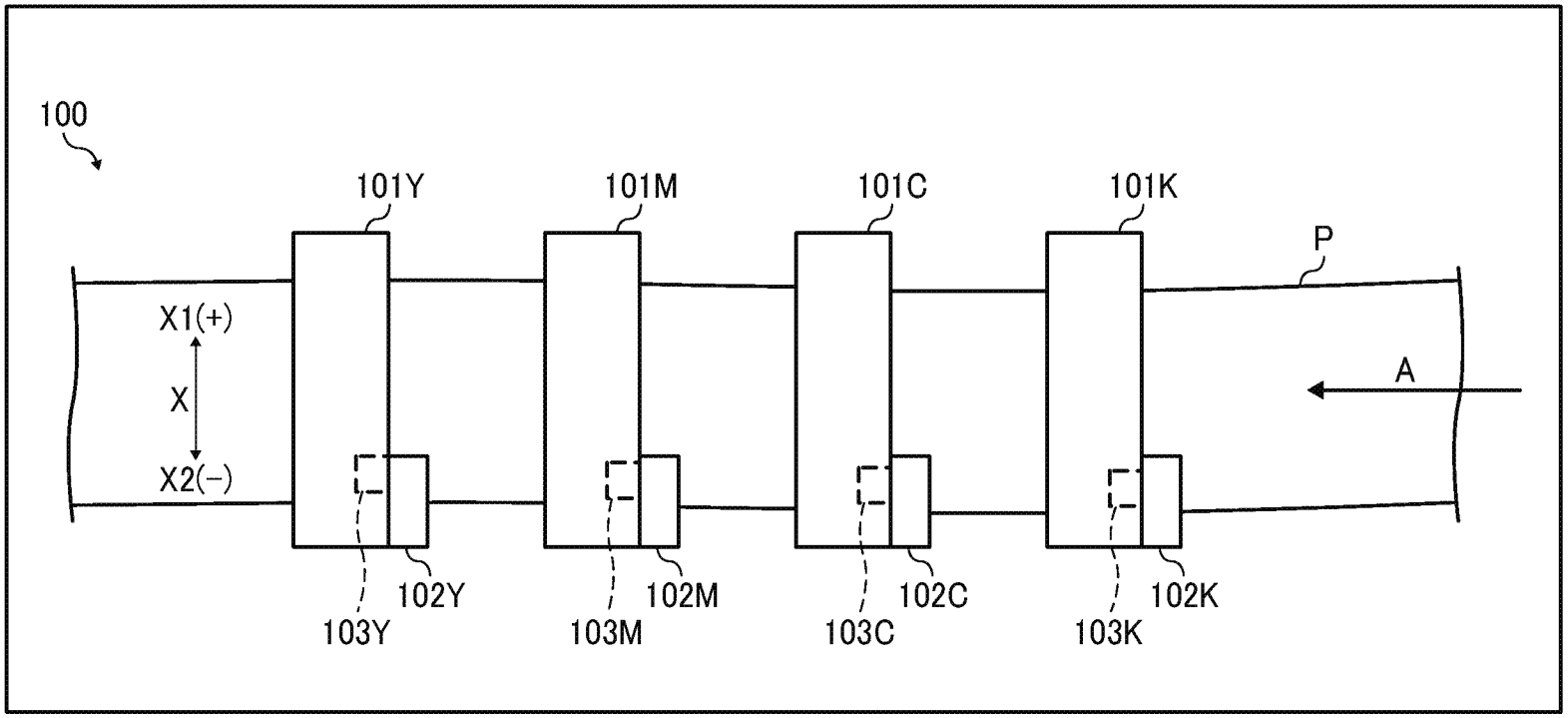
FIG. 13 is a schematic top view of a main structure of an image forming apparatus according to a variation.

FIG. 13 is a schematic top view of a main structure of an image forming apparatus according to a variation. The sensors 103 (103K, 103C, 103M, and 103Y) are preferably disposed such that, when viewed in the direction vertical to the surface of the sheet P as illustrated in FIG. 13, the detection range of the sensor 103 overlaps with a portion of the sheet P close to one end of the sheet P in the width direction indicated by arrow X.

In the variation, the sensors 103 are disposed facing the recording head 101 via the sheet P. Each sensor 103 includes, for example, a light-emitting element to emit light (e.g., laser light) onto the sheet P and an image sensor to image a range of the sheet P irradiated with the light emitted from the light-emitting element.

As the laser light emitted from the light-emitting element is diffused on the surface of the sheet P and superimposed diffusion waves interfere with each other, a pattern such as a speckle pattern appears. The image sensor of the sensor 103 captures and images such a speckle pattern. Based on the change of position of the pattern captured by the image sensor, the travel controller 127 can obtain the amount by which the recording head 101 is to be moved.

Additionally, in this structure, the recording head 101 and the sensor 103 are preferably disposed such that the operation area (e.g., the image formation area) of the recording head 101 overlaps, at least partly, with the detection range of the sensor 103 in the conveyance direction of the sheet indicated by arrow A.

Figure 14:
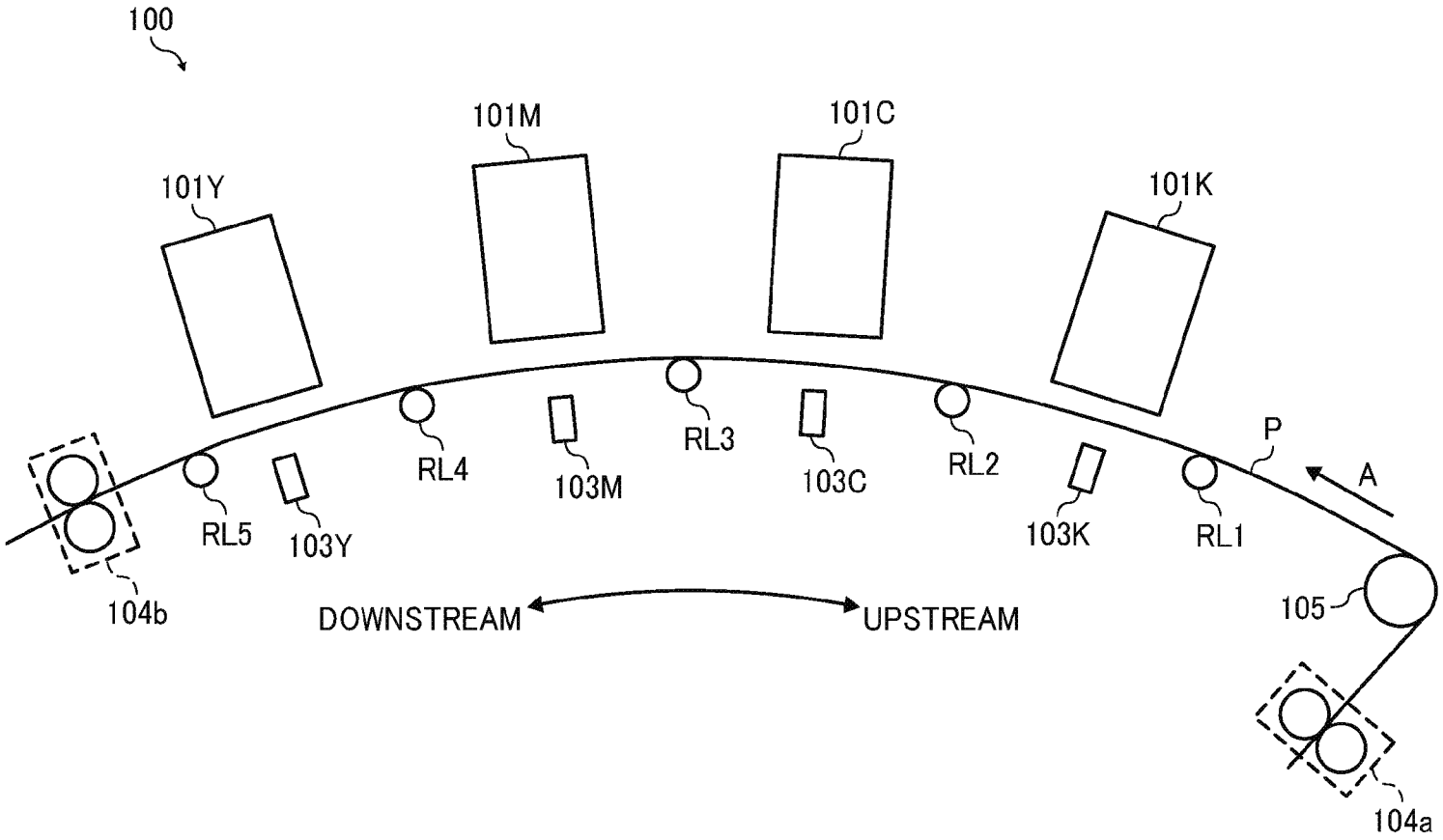
FIG. 14 is a schematic side view of the main structure of the image forming apparatus illustrated in FIG. 13.

FIG. 14 is a schematic side view of the main structure of the image forming apparatus 100 according to the variation. The configuration illustrated in FIG. 14 differs from the configuration illustrated in FIG. 3 regarding the locations of the first support and the second support. The image forming apparatus 100 illustrated in FIG. 14 includes supports RL1, RL2, RL3, RL4, and RL5, serving as the first and second supports, to support the sheet P. In other words, of the adjacent two of the multiple heads disposed at different positions in the conveyance direction A, the second support (e.g., the conveyance roller CR2K in FIG. 3) disposed downstream from the upstream head also serves as the first support (e.g., the conveyance roller CR1C in FIG. 3) disposed upstream from the downstream head. Note that, the support according to the variation, which doubles as the first and second supports, can be either a roller or a curved plate.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. For example, although the above-described embodiments concern image formation on continuous sheets (long sheets), one or more of aspects of this disclosure can adapt to image formation on cut sheets cut into a given size. Although the descriptions above concern the image forming apparatuses to eject liquid onto the sheets to form images, one or more of aspects of this disclosure can adapt to other apparatus types. For example, one or more of aspects of this disclosure can adapt to a patterning apparatus to form an electronic circuit pattern, with a functional ink, on a sheet conveyed.

Further, one or more of aspects of this disclosure can adapt to any configuration (in the form of apparatus, method, system, computer program, and computer program product) in which a device performs an operation on a conveyed object or processing of the conveyed object, using a head to move in the direction orthogonal to the direction of conveyance of the conveyed object. For example, one or more of aspects of this disclosure can adapt to a configuration in which a laser head moves in the direction orthogonal to the direction of conveyance of a substrate being a conveyed object. The laser head performs laser patterning on the substrate extends, and the laser head is moved according to detection of position of the substrate. A plurality of laser heads may be lined in the width direction.

The number of the heads is not necessarily to two or more. In other words, one or more of aspects of this disclosure can adapt to a device configured to keep applying an object discharged from a head to a reference position. In the case of a laser device, the device is configured to keep writing on a reference position.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions. Any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

What is claimed is:

1. A device comprising:

a head to perform an operation on an object, upon the object being conveyed in a conveyance direction;

a head moving device to move the head in a width direction orthogonal to the conveyance direction;

a position detector to detect a position of the object in the width direction, upon the object being conveyed;

a speed detector to detect a moving speed of the object in the width direction, upon the object being conveyed;

a position predictor to predict a width position of the object, upon the object being conveyed, after elapse of a time period, based on the position detected by the position detector and the moving speed generated detected by the speed detector;

a speed calculator to calculate a travel speed of the head in the width direction to cause the head to arrive at the width position obtained after the elapse of the time period; and a head travel controller to control the head moving device to move the head at the travel speed calculated by the speed calculator.

2. The device according to claim 1, wherein, in response to a direction of movement of the object in the width direction changing to a direction different from a travel direction of the head during travel control of the head, upon the object being conveyed, the head travel controller is configured to cause the head moving device to stop the head.

3. The device according to claim 1, wherein, in response to an amount of movement of the object in the width direction being relatively smaller than a threshold during travel control of the head, upon the object being conveyed, the head travel controller is configured to cause the head moving device to stop the head, the threshold being not relatively greater than an estimated movement amount of the object calculated based on the moving speed of the object detected by the speed detector, upon the object being conveyed.

4. The device according to claim 1, wherein the head and the position detector are disposed such that an operation area of the head overlaps, at least partly, with a detection range of the position detector in the conveyance direction of the object, upon the object being conveyed.

5. The device according to claim 1, wherein the position detector detects the position of the object in the width direction, based on a pattern on the object, upon the object being conveyed.

6. A method of controlling a head to perform an operation on an object, upon the object being conveyed in a conveyance direction, the method comprising:

moving the head in a width direction orthogonal to the conveyance direction of the object, upon the object being conveyed;

detecting a position of the object in the width direction, upon the object being conveyed;

detecting a moving speed of the object conveyed in the width direction, upon the object being conveyed;

predicting a width position of the object, upon the object being conveyed, after elapse of a time period, based on the position of the object detected and the moving speed of the object detected;

calculating a travel speed of the head in the width direction to cause the head to arrive at the width position predicted after the elapse of the time period; and moving the head at the travel speed calculated.

7. The method of claim 6, further comprising:

stopping the head in response to a direction of movement of the object in the width direction changing to a direction different from a travel direction of the head during travel control of the head, upon the object being conveyed.

8. The method of claim 6, further comprising:

stopping the head, in response to an amount of movement of the object in the width direction being relatively smaller than a threshold during travel control of the head, upon the object being conveyed, the threshold being not relatively greater than an estimated movement amount of the object calculated based on the detected moving speed of the object, upon the object being conveyed.

9. The method of claim 6, wherein the detecting includes detecting the position of the object in the width direction, based on a pattern on the object, upon the object being conveyed.

10. A computer-readable non-transitory recording medium storing a program for causing a computer to execute a method of controlling a head to perform an operation on an object, upon the object being conveyed in a conveyance direction, the method comprising moving the head in a width direction orthogonal to the conveyance direction of the object, upon the object being conveyed;

detecting a position of the object in the width direction, upon the object being conveyed;

detecting a moving speed of the object in the width direction, upon the object being conveyed;

predicting a width position of the object, upon being conveyed, after elapse of a time period, based on the position of the object detected and the moving speed of the object detected;

calculating a travel speed of the head in the width direction to cause the head to arrive at the width position predicted after the elapse of the time period; and moving the head at the travel speed calculated.

11. The computer-readable non-transitory recording medium of claim 10, wherein the method further comprises:

stopping the head in response to a direction of movement of the object in the width direction changing to a direction different from a travel direction of the head during travel control of the head, upon the object being conveyed.

12. The computer-readable non-transitory recording medium of claim 10, wherein the method further comprises:

stopping the head, in response to an amount of movement of the object in the width direction being relatively smaller than a threshold during travel control of the head, upon the object being conveyed, the threshold being not relatively greater than an estimated movement amount of the object calculated based on the detected moving speed of the object, upon the object being conveyed.

13. The computer-readable non-transitory recording medium of claim 10, wherein the detecting includes detecting the position of the object in the width direction, based on a pattern on the object, upon the object being conveyed.

14. An apparatus, comprising:

a conveyance mechanism to convey the object in a conveyance direction, wherein the object is a recording medium; and an image forming device, including the device of claim 1, to form an image on the recording medium.

15. The apparatus of claim 14, wherein the image forming device is configured to form the image on the recording medium in a speckle pattern, and wherein the position detector is configured to detect a position of the object in the width direction, upon the object being conveyed, based upon an amount of displacement of the speckle pattern in the image.

16. An apparatus, comprising:

a conveyance mechanism to convey the object in a conveyance direction, wherein the object is a recording medium; and an image forming device, including the device of claim 2, to form an image on the recording medium.

17. The apparatus of claim 16, wherein the image forming device is configured to form the image on the recording medium in a speckle pattern, and wherein the position detector is configured to detect a position of the object in the width direction, upon the object being conveyed, based upon an amount of displacement of the speckle pattern in the image.

18. An apparatus, comprising:

a conveyance mechanism to convey the object in a conveyance direction, wherein the object is a recording medium; and an image forming device, including the device of claim 3, to form an image on the recording medium.

19. The apparatus of claim 18, wherein the image forming device is configured to form the image on the recording medium in a speckle pattern, and wherein the position detector is configured to detect a position of the object in the width direction, upon the object being conveyed, based upon an amount of displacement of the speckle pattern in the image.

* * * * *